United States Patent [19]

Buck

[11] Patent Number: 4,534,125

[45] Date of Patent: Aug. 13, 1985

[54] GARDEN ROW MARKER

[76] Inventor: David J. Buck, P.O. Box 177, Enterprise, Miss. 39330

[21] Appl. No.: 629,055

[22] Filed: Jul. 9, 1984

[51] Int. Cl.[3] ..... G09F 3/18

[52] U.S. Cl. ..... 40/10 C; 40/10 D

[58] Field of Search ..... 40/10 C, 10 D, 10 R

[56] References Cited

U.S. PATENT DOCUMENTS

| | | | |
|---|---|---|---|
| 1,889,281 | 11/1932 | Fitzgerald | 40/10 C |
| 2,181,977 | 12/1939 | Magovern | 40/10 C |
| 2,333,302 | 11/1943 | Enk | 40/11 |
| 2,639,524 | 5/1953 | Irving | 40/10 C |
| 4,079,530 | 3/1978 | Atherton et al. | 40/10 C |
| 4,079,533 | 3/1978 | Rohner | 40/359 |
| 4,196,533 | 4/1980 | Kamphausen | 40/10 C |

FOREIGN PATENT DOCUMENTS

| | | | |
|---|---|---|---|
| 1485558 | 6/1967 | France | 40/10 C |
| 30200 | 3/1977 | Japan | 40/10 D |
| 1375195 | 11/1974 | United Kingdom | 40/10 D |

*Primary Examiner*—Gene Mancene
*Assistant Examiner*—Cary E. Stone
*Attorney, Agent, or Firm*—Lee, Smith & Zickert

[57] ABSTRACT

A garden row marker comprised of a clear plastic hollow body defining an interior display chamber, and a stake means depending from said hollow body and being integrally formed therewith. The hollow body has an upper open end with a peripheral lip adapted to be snap-engaged by a sealing cap formed, preferably, of a brightly colored opaque plastic. The marker allows for the visibility of a seed package stored within the display chamber from all sides therearound.

10 Claims, 7 Drawing Figures

GARDEN ROW MARKER

BACKGROUND AND SUMMARY OF THE INVENTION

The invention relates to a marker for gardens whereby the particular vegetation planted in a certain row can be identified continuously during the growing and harvesting season. Particularly, the invention relates to a marker that is sealable to be weatherproof and allows for the visible storage of an informational placard, such as seed packet, for as long as marking is required for identifying the vegetation planted.

In the past, gardeners have used a variety of wooden or metal stakes that have the identities of the plants embossed thereon, or have seed packs, or the like, attached thereto. In such marking devices, the indica can be washed away due to weathering and watering of the plants. Additionally, such markers are not generally re-usable and makeshift device must be re-constructed from time to time. With the suceptibility to weather and related damage, the visibility of the identifying indica is reduced and thereby diminishes the marking function and whole purpose thereof.

Moreover, previous marking devices have not effectively provided the capability of designating plantings at either side of the marker, such as along two adjacent rows planted with different items.

As a result, it is a primary goal of this invention to provide a garden row marker which is weatherproof and provides a clearly visible identifying means throughout an entire growth season.

Another object of the invention is to provide a garden row marker which is easily sealed from the top whereby a seed packet, or the like, can be protected therein.

A related goal of the invention is provide a garden row marker that is made of an endurable clear plastic material allowing the gardener to easily determine the identification of plantings in various rows.

A corresponding goal of the invention is to provide a garden row marker which also permits of use with plural identifying means visible at opposite sides of the marker, whereby at least two different planted items may be identified to either side thereof.

In brief summary, the garden row marker of the invention may be described as an integrally molded clear plastic stake and hollow body of a size which can receive and retain a slip of paper, seed packet, or the like therein. In addition, the invention includes a cap, preferably brightly covered, that resiliently engages the top of the hollow body whereby to protect the plant-identifying means therebelow. The hollow body has a bottom wall which is integrally formed with a multi-flanged stake for penetrating the ground. The bottom wall also includes a vent means which prevents the interior of the hollow body from fogging and also permits condensation to be drained therefrom.

BRIEF DESCRIPTION OF THE DRAWINGS

The invention is described in greater detail in the following description of the prefered embodiment, taken in conjunction with the drawings, in which.

DETAILED DESCRIPTION OF THE PREFERRED EMBODIMENT

Figure 1:
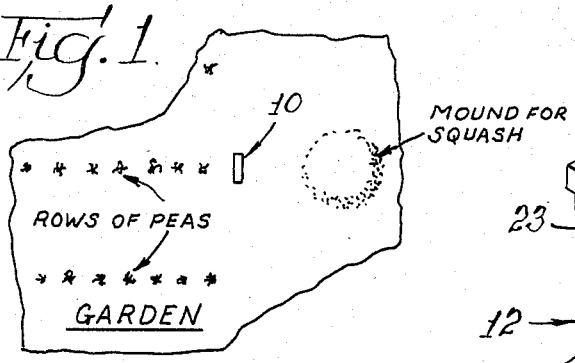
FIG. 1 is a plan view of a garden having, in accordance with the invention, the garden row marker with two different types of vegetation planted on either side thereof.
Figure 2:
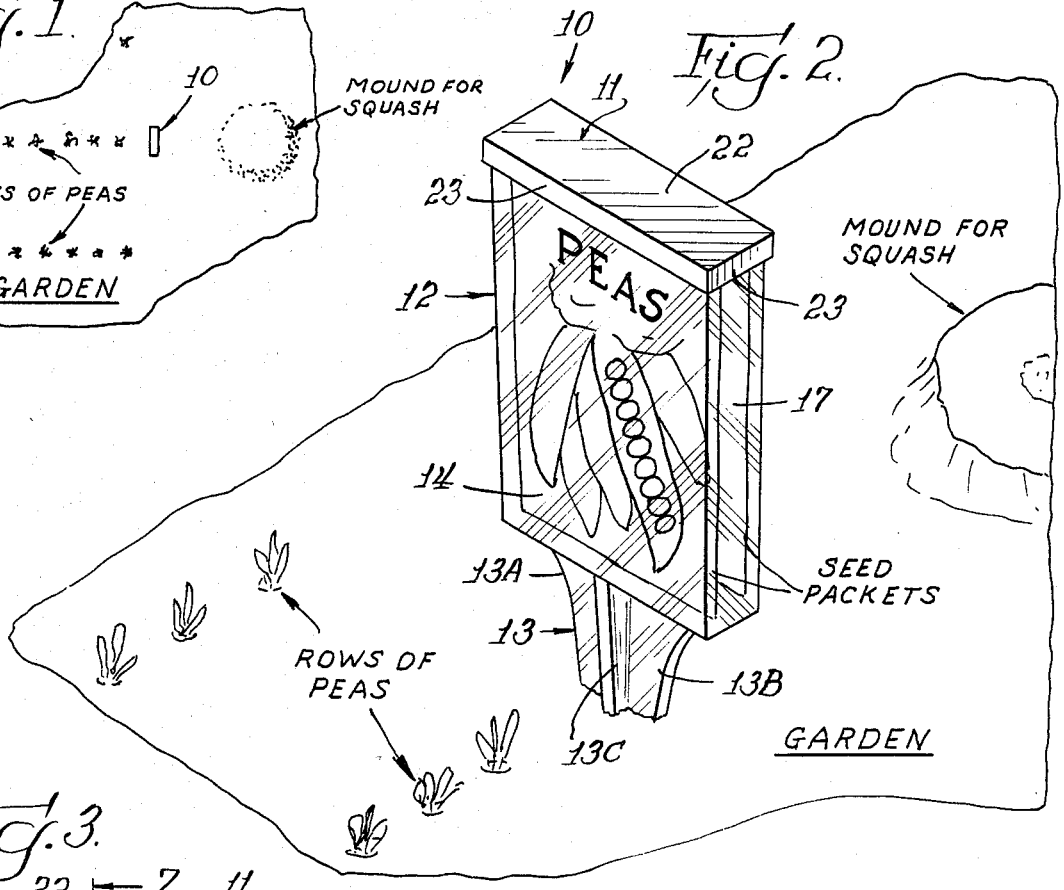
FIG. 2 is a perspective view looking downwardly on a portion of the garden as shown in FIG. 1., wherein the garden row marker of the invention is provided with seed packets to identify plantings at opposite sides thereof.
Figure 3:
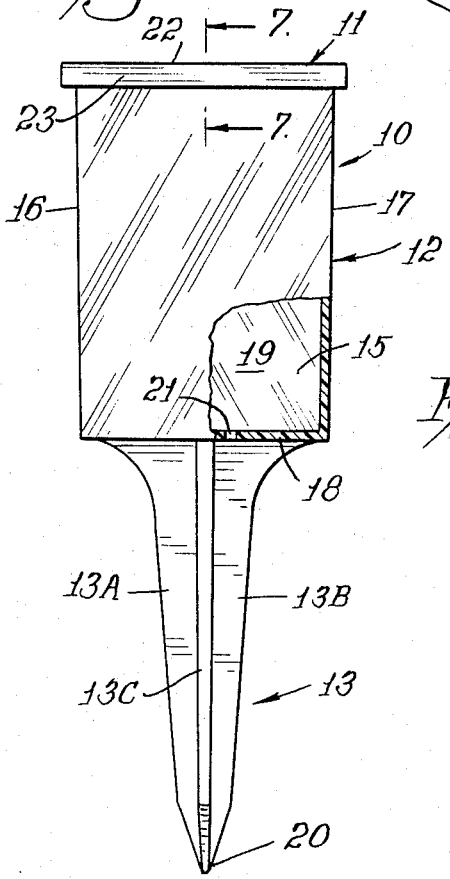
FIG. 3 is a front elevational view of the garden row marker as shown in FIG. 1.
Figure 4:
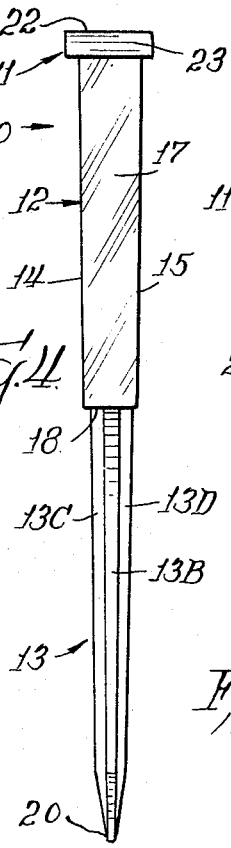
FIG. 4 is a side elevational view thereof.

For purposes of explaining the function of the invention, FIGS. 1 and 2 illustrate the placement of garden row marker 10 in conjunction with the planting of rows of peas on one side and mounds for squash planted to the other side. Garden row marker 10 includes a cap 11 which is preferably opaque and of a bright color. A suitable thermoplastic resin, such as polypropylene, is envisioned for making cap 11 by injection molding.

Cap 11 is designed to resiliently engage along the top opening of hollow body 12. Hollow body 12 is preferably injection molded integrally with a stake means 13 depending therefrom. A transpicuous thermoplastic, such as a copolymer of styrene and acrylonitrile, is highly suitable. Thereby, plant-indicating materials, such as the seed package shown in FIG. 2, can be placed inside of the hollow body 12 to be easily viewed by the gardener.

With reference to FIGS. 3–7, a more detailed representation of marker 10 is shown. The clear plastic hollow body 12 is formed with opposing long sidewalls 14 and 15. They are joined at there ends by transversely positioned, and opposing, shorter sidewalls 16 and 17, whereby hollow body 12 is generally rectangular in plan. A bottom wall 18 is integrally formed with the four walls and stake means 13. Thus, hollow body 12 is upwardly open and forms a display chamber 19 therein.

In order to provide a sturdy ground penetrable support, stake means 13 is provided in a multi-flanged arrangement. In the preferred embodiment, four flanges 13A, 13B, 13C and 13D are formed to be at generally right angles one to the other. At there lower ends they sharply taper to provide a ground insertable point 20. Flanges 13A and 13B are generally parallel to walls 14 and 15. Transversely, flanges 13C and 13D are parallel to the shorter sidewalls 16 and 17, and are accordingly narrower than flanges 13A and 13B, as best viewed in FIG. 4.

Bottom wall 18 is provided with a vent 21 which provides an anti-fog means, as well as allowing condensation to be drained from display chamber 19. Thus, the hollow body 12 remains clear during temperature and humidity changes.

Figure 5:
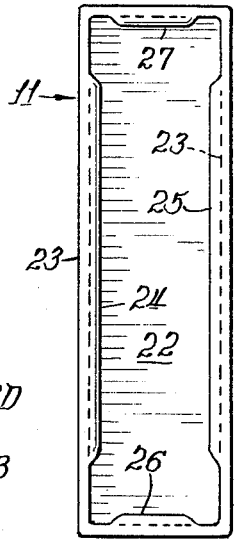
FIG. 5 is a bottom view of the cap of the garden row marker.
Figure 7:
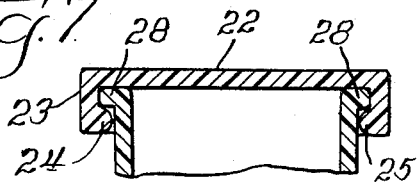
FIG. 7 is a cross-sectional view of the garden row marker taken generally along line 7—7 of FIG. 3.

With specific reference now made to FIGS. 5 and 7, it will be seen that cap 11 includes a flat top 22 with a peripheral depending sidewall 23. Cap 11 is generally rectangular in plan in conformance with the shape of hollow body 12 and includes opposing snap-on ribs 24 and 25 extending inwardly from the long sides of sidewall 23. Along the shorter sides of sidewall 23, opposing and inwardly extending snap-on ribs 26 and 27 are provided. The ribs are each generally centrally located along the respective sides of the rectangular shape, but terminate short of the corners in order to achieve a resilient snap-on arrangement.

Figure 6:
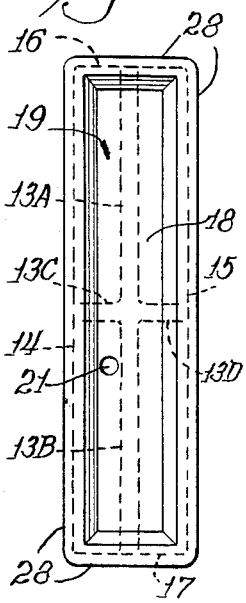
FIG. 6 is a top view of the hollow body of the garden row marker.

As best viewed in FIG. 6 taken in conjunction with FIG. 7, it will be apparent that the hollow body 12 includes an upper peripheral lip 28 extending around the top edges of walls 14–17. The lip 28 extends outwardly of the walls substantially the same distance as ribs 24–27 extend inwardly from the sidewall 23. Thereby, cap 11 is capable of being snapped-over lip 28 for a resilient tight securement over the display chamber 19. Thus, a weather resistent sealing engagement is provided which will safely contain the identifying materials.

For purpose of removing body 12 from the injection mold, sidewalls 14–17 are provided with draft and taper slightly. Accordingly, the bottom wall 18 is slightly smaller than the top opening of hollow body 12. In the exemplary embodiment, hollow body 12 is constructed to hold a standard seed box or seed envelope, which typically measures 4½ inches by 3 inches by ½ inch. When packets are emptied, they are capable of being flattened whereby one or two packets may be easily retained within display chamber 19 to identify plantings at one side or both sides of the marker 10. For example, marker 10 is used to identify the rows of peas and squash mounds depicted in FIG. 2. The display chamber 19 also may be used for storing data relative to planting dates, cultivation, watering, fertilization, and other schedules, which the gardener may wish to maintain in a readily accessible location. Thus, the garden row marker can serve additional functions in this regard other than simply identifying the types of plants. Further, this additional information may be provided on thin slips of paper and inserted adjacent sidewalls 16 and 17, which are also transpicuous surfaces. As a result, the gardener may utilize marker 10 for the storage of any relevant information needed.

As stated, cap 11 is preferably made of a brightly colored polypropylene material. Caps may be provided in a range of colors which can also aid in identifying and providing information about the planted vegetation. For example, a red cap might indicate a certain type of fertilization required and a green cap another. When a plurality of garden markers are required, different cap colors might be used to designate corresponding types of vegetation, in addition to the information stored within display chamber 19.

Garden row marker 10 is also beneficial for achieving tidy and neat markings in gardens, which helps in maintaining a well organized and aesthetically pleasing garden arrangement.

Being made from weather-resistant materials, marker 10 can be used year after year at different garden locations. During the course of a growing season, access to the interior of display chamber 19 is easily obtained by snap-disengaging cap 11. This permits the gardener to change the information on the material stored within chamber 19 as the gardening schedule evolves.

Stake means 13 is provided with four flanges in the preferred embodiment, but clearly other stake configurations are intended to be within the scope of the invention. The four-flanged stake arrangement is, however, preferable since it provides a very sturdy support and resists being toppled over by rain, wind or accidental bumping.

Accordingly, a weather resistant garden row marker is provided which includes a transpicuous hollow body forming a display chamber for easy recognition of indica stored therein. A snap-engaging cap is provided to sealingly maintain the indica within the display chamber and permits ready access when changes to the informatin are required. The garden row marker is re-usable year after year, aesthetically pleasing, and creates a well organized garden.

What is claimed is:

1. A garden row marker for retaining informational materials concerning vegetation planted in a garden, said marker comprising a transpicuous hollow body integrally formed with a depending stake means, the hollow body having an interior display chamber for retaining informational materials to be visible to the gardener, said display chamber being defined by a plurality of continuous planar sidewalls therearound and integrally formed at lower edges thereof with a bottom wall defining the bottom of the display chamber, said sidewalls having a continuous top edge circumscribing an upward opening of said display chamber, the sidewalls including a peripheral lip extending outwardly generally around the top edge thereof, and a removable solid cap having means for resiliently-engaging said hollow body portion at said sidewall peripheral lip, whereby said display chamber is sealable to enable informational materials to be safely stored therein for use in a garden.

2. The garden row marker as in claim 1 wherein the bottom wall includes a vent means.

3. A garden row marker as in claim 1 wherein the stake means extends downwardly from the bottom wall.

4. A garden row marker as in claim 3 wherein the stake means has a multi-flanged configuration.

5. A garden row marker as in claim 4 wherein multiple flanges converge downwardly and terminate at a ground penetrable pointed end.

6. The garden row marker as in claim 1 wherein the cap is an opaque colored plastic.

7. Garden row marker as in claim 1 wherein the display chamber is capable of retaining at least two seed packets therein.

8. A thermoplastic garden row marker having a removable opaque cap and a clear hollow body having a four-sided continuous wall forming therebetween an interior display chamber visible from the outside through said four-sided wall, said four-sided wall being integrally formed with a bottom wall forming a bottom of the display chamber, said four-sided wall having a top edge circumscribing an open top of said display chamber, said four-sided wall including an outwardly extending lip means generally arranged around said top edge, a stake means integrally formed with said bottom wall and depending therefrom whereby to provide means for inserting said marker into the ground, said cap including resiliently engageable means for snap-engagement with said lip means of the four-sided wall.

9. A garden row marker comprising an injection molded clear plastic hollow body and stake means, said hollow body having an open top and closed bottom defining an interior display chamber visible from the exterior of the marker, the open top of the hollow body bounded therearound by a top edge of the hollow body, said hollow body further having lip means extending outwardly generally around said top edge, said stake means being integrally formed with the hollow body and depending downwardly from the closed bottom to facilitate inserting the marker into the ground, and a removable cap made of an opaque thermoplastic material and having resiliently engageable rib means capable of snap-engagement with the lip means of the hollow body to sealingly cover the open top thereof.

10. The garden row marker as in claim 9 wherein the hollow body closed bottom comprises a bottom wall means, said bottom wall means further including a vent means extending therethrough to open into said display chamber.

* * * * *